United States Patent [19]

Sakamoto

[11] Patent Number: 4,558,616

[45] Date of Patent: Dec. 17, 1985

[54] PUNCH PRESS HAVING RETRACTABLE PUNCHING TOOLS

[75] Inventor: Katsuyoshi Sakamoto, Isehara, Japan

[73] Assignee: Amada Company, Limited, Japan

[21] Appl. No.: 548,417

[22] Filed: Nov. 3, 1983

[30] Foreign Application Priority Data

Nov. 5, 1982 [JP] Japan ..... 57-193397

[51] Int. Cl.[4] ..... B26F 1/14

[52] U.S. Cl. ..... 83/399; 83/368; 83/563

[58] Field of Search ..... 83/399, 400, 564, 563, 83/368

[56] References Cited

U.S. PATENT DOCUMENTS

| | | | |
|---|---|---|---|
| 3,253,492 | 5/1966 | Petros et al. | 83/563 X |
| 3,392,613 | 7/1968 | Johns | 83/412 X |
| 3,874,262 | 4/1975 | Cailloux | 83/549 |
| 3,937,113 | 2/1976 | Pancook et al. | 83/564 X |
| 3,964,358 | 6/1976 | Stefano | 83/564 X |
| 4,391,123 | 7/1983 | Salvagnini | 83/412 X |
| 4,399,725 | 8/1983 | Milan | 83/581 X |

*Primary Examiner*—James M. Meister

*Attorney, Agent, or Firm*—Wigman & Cohen

[57] ABSTRACT

The present invention relates to a punch press having upper and lower punching tools to punch a workpiece, a workpiece positioning device to move and position the workpiece, a lower tool support member on which the lower punching tool is detachably mounted, and a slide base on which the tool support member is slidably mounted. The boundary surfaces between the tool support member and the slide base are inclined to allow the lower tool to be obliquely lowered away from the workpiece positioning device.

4 Claims, 5 Drawing Figures

PUNCH PRESS HAVING RETRACTABLE PUNCHING TOOLS

BACKGROUND OF THE INVENTION

1. Field of the Invention

The present invention relates generally to a punch press for punching sheet-like workpieces such as sheet metals and, more particularly, to a punch press which is provided with plurality of punching tools and a workpiece feeding and positioning means.

2. Description of the Prior Art

There is a type of punch press which is provided with a plurality of upper and lower punching tools and a workpiece feeding and positioning means having a plurality of clamping means. The arrangement is such that the clamping means of the workpiece feeding and positioning means will grip a workpiece to be punched and bring the same onto a desired lower punching tool for a punching operation.

In such a punch press, it is inconvenient that the clamping means of the workpiece feeding and positioning means, when feeding a workpiece to be punched onto a desired lower punching tool, will often interfere with other lower punching tools than the desired one by which the workpiece is to be punched. If the clamping means of the workpiece feeding and positioning means should interfere with the lower punching tools, of course both the clamping means and the lower punching tools will be hurt and broken. Therefore, in order to avoid such interference with the lower punching tools, it is necessary that the clamping means of the workpiece feeding and positioning means should clamp portions of the workpiece which are far away from each other by a comparatively big distance. However, it is very inconvenient to clamp the workpiece in such a manner in that a large area of the workpiece between the portions clamped by the clamping means of the workpiece feeding and positioning means could not be punched as a so-called dead zone.

SUMMARY OF THE INVENTION

It is an object of the present invention to provide a punch press in which clamping means of a workpiece feeding and positioning means will not interfere with lower punching tools so that the lower punching tools and the clamping means will not be hurt.

It is another object of the present invention to provide a punch press in which a dead zone of a workpiece which can not be punched is decreased so that a widest scope of the workpiece can be effectively and economically processed.

In order to attain the above objects, a punch press according to the present invention is so arranged that some of lower punching tools can be lowered from the level of clamping means of a workpiece feeding and positioning means to move out of the way of the same.

Other and further objects and advantages of the present invention will be apparent from the following description and accompanying drawings which, by way of illustration, show a preferred embodiment of the present invention and the principles thereof.

DESCRIPTION OF THE PREFERRED EMBODIMENT

Figure 1:
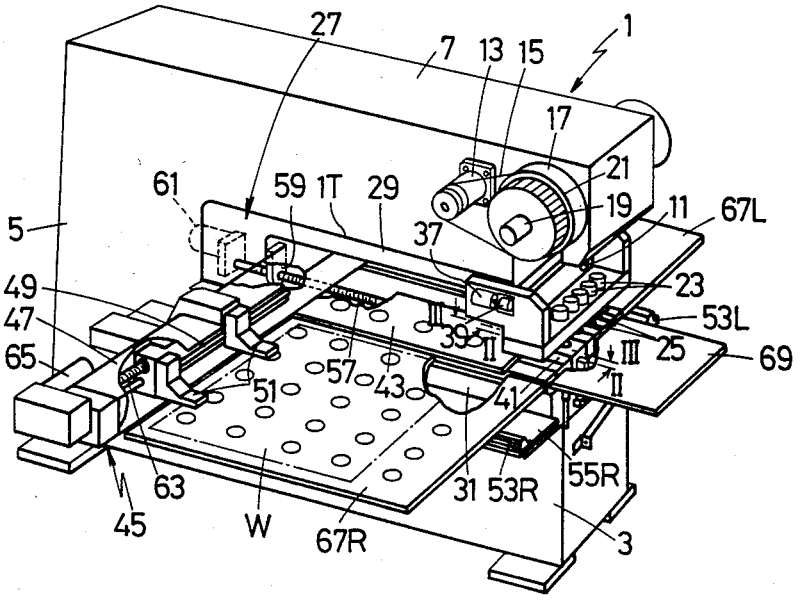
FIG. 1 is a perspective view of a punch press embodying the principles of the present invention.
Figure 3:
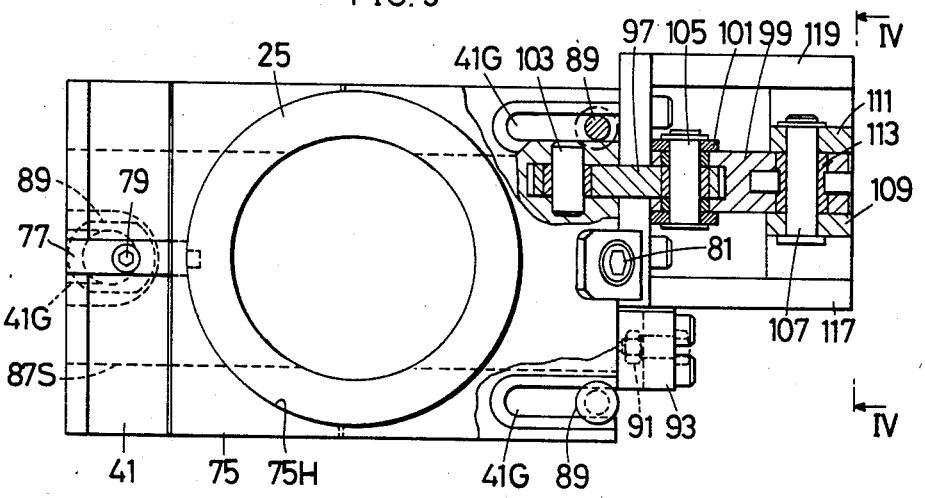
FIG. 3 is a top plan view of a portion of the punch press shown in FIG. 2 taken in the direction of the arrows III—III of FIG. 1.

Referring now to FIG. 1, there is shown a punch press which is generally designated by the numeral 1 and is used to punch sheet-like workpieces such as sheet metals. The punch press 1 is constructed of an elongated base 3, a column 5 vertically fixed to an end of the base 3 and an overhead beam 7 which is integrally connected to the top of the column 5 in a cantilever manner to extend in parallel with the base 3 to provide a throat 1T therebetween. Also, the punch press 1 comprises a ram which is vertically movably disposed at the free end of the overhead beam 7 to move toward and away from the base 3 in operation. The ram is provided at its lower portion with a striker 11 for punching operations which is so disposed as to laterally shift thereon rightward and leftward. Also, the ram is so arranged as to be vertically driven by a motor 13 through a belt 15 and a flywheel 17 having an eccentric shaft 19 and a clutch 21 to perform punching operations.

The punch press 1 is provided with a plurality of upper punching tools 23 standing in a horizontal line and a plurality of lower punching tools 25 likewise standing in a horizontal line according to the present invention. More particularly, each of the groups of the upper and lower punching tools 23 and 25 is disposed to be in a horizontal line which is along the X axis or at right angles to the direction of the extension of the elongated base 3. The upper and lower punching tools 23 and 25 are varied in size and shape, and they are so arranged that pairs of the upper and lower tools 23 and 25 common in size and shape are vertically aligned with each other. Thus, the arrangement is such that in punching operations the striker 11 which can laterally shift will be lowered by the ram to act on the pairs of the upper and lower tools 23 and 25 common in size and shape.

In order to hold the upper and lower tools 23 and 25 in the above described manner, there is provided a C-shaped tool holding unit 27 which is mounted on the top of the base 3 in such a manner to extend overall thereon. The tool holding unit 27 is provided with a pair of upper and lower arms 29 and 31 which are so formed as to extend in parallel with each other in the same direction in cantilever manners to hold the upper and lower tools 23 and 25, respectively. Of course, the upper and lower tools 23 and 25 are held in the horizontal lines on the upper and lower arms 29 and 31 of the tool holding unit 27 so that pair of them common in size and shape are vertically aligned. In this connection, the striker 11 which is held by the ram is so arranged as to be laterally moved just over the upper and lower tools 23 and 25 by a motor 37 through a belt 39 to selectively act on a desired pair of them when the ram is lowered. Also, a plate-like fixed table 43 is provided on the lower arm 31 in such a manner as to extend over the base 3 so that a workpiece W to be punched can slide thereon into between the upper and lower punching tools 23 and 25.

In order to feed and position the workpiece W to be punched, a feeding and positioning apparatus 45 is provided in a manner such that it is moved between the upper and lower arms 29 and 31 of the tool holding unit 27. The feeding and positioning apparatus 45 comprises a first carriage 47 which is movable toward and away from the upper and lower tools 23 and 25 and a second carriage 49 which is slidably mounted on the first carriage 47 and holds a clamping means 51 for clamping the workpiece W. The first carriage 47 is slidably mounted on rails 53R and 53L which are horizontally disposed on elongated plates 55R and (55L) horizontally fixed to the sides of the lower arm 31 of the tool holding unit 27. The first carriage 47 is so arranged as to be moved on the rails 53R and 53L by a lead screw 57 which is horizontally provided between the fixed table 43 and the lower arm 31 of the tool holding unit 27. The screw 57 is connected to the first carriage 47 by means of a nut 59 and is connected to a motor 61 which is provided at the back of the tool holding unit 27. Also, the second carriage 49 holding the clamping means 51 is mounted on the first carriage 47 so that it may be moved at right angles with the rails 53R and 53L. The second carriage 49 is so arranged as to be moved by a lead screw 63 which is horizontally provided in the first carriage 47 and is connected to a motor 65. Also, a pair of movable tables 67R and 67L may be horizontally fixed to the first carriage 47 to hold the extending ends of the workpiece W to be punched. Thus, it will be understood that the tool holding unit 27 and the feeding and positioning apparatus 45 are combined with each other as such a unit as shown in FIG. 1 and they are mounted between the overhead beam 7 and the base 3. Also, a collapsible table 69 may be provided at the front end of the base 3.

In the above described arrangement, the workpiece W which is gripped by the clamping means 51 of the feeding and positioning apparatus 45 can be fed into and positioned between the upper and lower punching tools 23 and 25 by moving the first carriage 47 and the second carriage 49. Before or as soon as the workpiece W is positioned between the upper and lower punching tools 23 and 25, the striker 11 held by the ram is laterally moved thereon and positioned just over a desired pair of the upper and lower punching tools 23 and 25 by a motor 37 and a timing belt 39. Then, when the ram is lowered, the striker 11 will be lowered to enable the desired pair of the upper and lower tools 23 and 25 to punch the workpiece W which is held by the clamping means 51 of the feeding and positioning apparatus 45. Of course, a number of holes varied in size and shape can be automatically and continuously punched in the workpiece W by moving the striker 11 on the ram and first and second carriage 47 and 49 under a numerical control which has been preprogrammed.

Referring to FIGS. 2 through 5, each of the lower punching tools 25 is detachably mounted on the lower tool holder 41 by means of a tool support 75 which is square in shape and is formed at its center with a hole 75H for the lower punching tool 25. As is conventional, each of the lower tool holders 41 is formed at its center with a hole 41H so that scraps cut from the workpiece W during punching operations may be dropped therethrough. Also, each of the lower punching tools 25 is formed at its periphery with a vertical key way 25K, and a key 77 is fixed to the lower tool holder 41 by a bolt 79 in engagement with the key way 25K so as to stop the lower punching tool 25 from rotating in the tool support 75 and the lower tool holder 41. The tool support 75 is detachably fixed to the lower tool holder 41 by a bolt 81 which is releasably engaged with a nut 83 which is pivotally supported by a pin 85 in a vertical slot 41S formed on the lower tool holder 41. Thus, the tool support 75 can be easily removed from the lower tool holder 41 to change the lower punching tool 25 by releasing the bolt 81 a little in the nut 83 and downwardly swinging the bolt 81 together with the nut 83 around the pin 85.

Referring also to FIGS. 2 through 5, some of the lower tool holders 41 are so arranged as to be lowered to bring the lower punching tools 25 out of the way of the clamping means 51 of the workpiece feeding and positioning apparatus 45 according to the present invention. For this purpose, such a lower tool holder 41 is provided at its bottom with an oblique slide surface and is slidably mounted on a sloped side base 87 which is fixed on the front end of the lower arm 31 of the tool holding unit 27. More particularly, the slide surface of the lower tool holder 41 is designed to descend forwardly, and the slide base 87 is provided at its top with a slide guide way 87S descending forwardly. Also, the tool holder 41 is formed with a plurality of guide slots 41G through which bolts 89 are fixed to the slide base 87 so that the tool holder 41 may be guided by the bolts 89 when sliding on the slide base 87. Of course, the arrangement is such that the lower tool holder 41 will be lowered and raised to lower and raise the lower punching tool 25 when it is moved on the slide guide way 87S of the slide base 87. Also, in order to sense the lowering and rising of the lower tool holder 41, there is provided sensing means 91 which is held at the back of the lower tool holder 41 by means of a bracket 93. Thus, it will be understood that the lower punching tool 25 can be lowered out of the way of the clamping means 51 of the workpiece feeding and positioning apparatus 45 when the tool holder 41 is pulled forwardly on the slide guide way 87S of the slide base 87.

Figure 2:
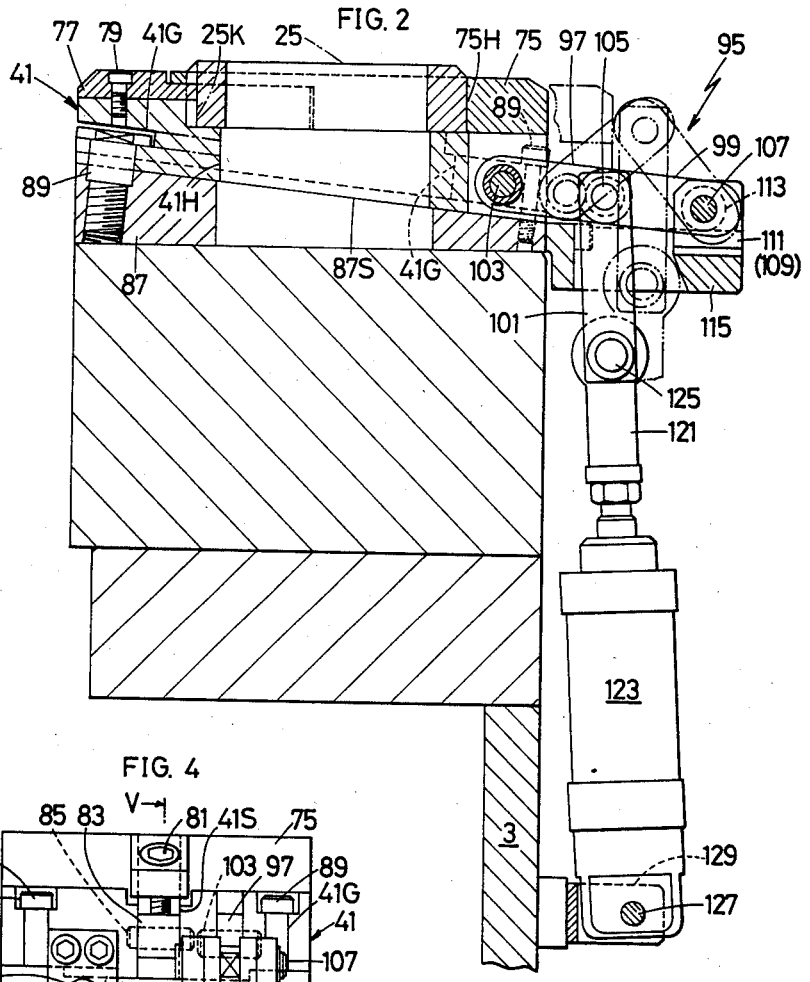
FIG. 2 is a sectional view substantially taken along the line II—II of FIG. 1.
Figure 4:
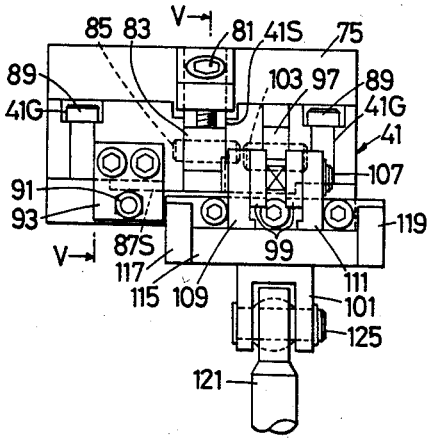
FIG. 4 is a front elevational view of the portion of the punch press shown in FIG. 2 taken in the direction of the arrows IV—IV of FIG. 3.
Figure 5:
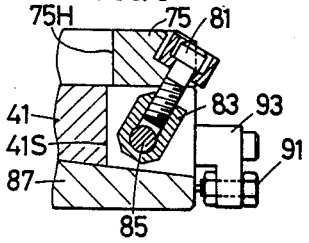
FIG. 5 is a sectional view taken along the line V—V of FIG. 4.

As best shown in FIG. 2, in order to move the lower tool holder 41 on the slide base 87, there is provided a toggle mechanism 95 which comprises a first link 97, a second link 99 and a third link 101. The first link 97 is pivotally connected to the lower tool holder 41 by a pin 103, and the second and third links 99 and 101 are pivotally connected to the first link 97 by a pin 105. The second link 99 is also connected pivotally to a pin 107 which is held between a pair of holding members 109 and 111, and preferably it may be connected to the pin 107 by means of an eccentric bush 113 for adjustment. The holding members 109 and 111 between which the pin 107 is held are fixed to a bracket 115 which is horizontally fixed to the slide base 87 by a pair of parallel arms 117 and 119. Also, the third link 101 is disposed to depend from the pin 105 downwardly between the arms 117 and 119 and is pivotally connected at its lower end to a piston rod 121 of a hydraulic or pneumatic motor 123 by a pin 125. The hydraulic or pneumatic motor 123 is disposed with its piston rod 121 upwardly projecting and is pivotally connected to the base 3 of the punch press 1 by means of a pin 127 and a clevis 129. Thus, the arrangement is such that the lower tool holder 41 will be moved on the slide base 87 by the hydraulic or pneumatic motor 123 through the first, second and third links 97, 99 and 101 of the toggle mechanism 95 when the piston rod 121 of the hydraulic or pneumatic motor 123 is moved up and down. It will be understood that the lower punching tool 25 can be lowered out of the way of the clamping means 51 of the workpiece feeding and positioning apparatus 45 when the piston rod 121 of the hydraulic or pneumatic motor 123 is extended to pull the lower tool holder 41 by means of the toggle mechanism 95.

As has been thus far described in the above, the lower punching tools 25 can be lowered from the level of the clamping means 51 of the workpiece feeding and positioning apparatus 45 by lowering the lower tool holder 41 on the slide base 87 by means of the hydraulic or pneumatic motor 123 through the toggle mechanism 95. Accordingly, when the workpiece W to be punched in to be fed onto a desired lower punching tool 25 by the clamping means 51 the workpiece feeding and positioning apparatus 45, the others of the lower punching tools 25 can be lowered to move out of the clamping means 51 to avoid an interference therewith. Therefore, the clamping means 51 of the workpiece feeding and positioning apparatus 45 can clamp portions of the workpiece W to be punched which are close to each other so that a widest scope of the workpiece W can be effectively and economically punched or processed.

Although a preferred form of the present invention has been illustrated and described, it should be understood that the device is capable of modification by one skilled in the art without departing from the principles of the invention. Accordingly, the scope of the invention is to be limited only by the claims appended hereto.

I claim:

1. A punch press, comprising:

an upper punching tool and a corresponding lower punching tool to punch a workpiece;

workpiece positioning means to move and position the workpiece;

a lower punching tool holder having a planar lower surface arranged obliquely with respect to the top surface of the lower punching tool;

a slide base fixed to such punch press having an upper planar surface arranged parallel with the planar lower surface of the lower punching tool holder; and means for temporarily sliding the lower punching tool holder along the upper planar surface of the slide base so as to obliquely lower the lower punching tool into an inactive position with respect to the workpiece positioning means.

2. A punch press according to claim 1 further comprising a sensor means for detecting the relative position between the lower tool holder and the slide base.

3. A punch press according to claim 2 in which the mechanism for sliding the lower tool holder is a toggle mechanism.

4. The punch press according to claim 1, further comprising a toggle means for moving the tool holder along the slide base.

* * * * *

UNITED STATES PATENT AND TRADEMARK OFFICE

CERTIFICATE OF CORRECTION

PATENT NO. : 4,558,616

DATED : December 17, 1985

INVENTOR(S) : KATSUYASHI SAKAMOTO

It is certified that error appears in the above—identified patent and that said Letters Patent is hereby corrected as shown below:

Claim 1, column 6, line 12 replace "such" with --said--.

Signed and Sealed this

*First* Day of *April 1986*

[SEAL]

*Attest:*

DONALD J. QUIGG

*Attesting Officer*

*Commissioner of Patents and Trademarks*